US005728348A

United States Patent [19]

Tamura et al.

[11] Patent Number: 5,728,348

[45] Date of Patent: Mar. 17, 1998

[54] LADLE COVER FOR VACUUM REFINING PROCESS

[75] Inventors: Nozomu Tamura; Sumio Yamada; Masaru Washio; Toshio Kanatani, all of Chiba, Japan

[73] Assignee: Kawasaki Steel Corporation, Kobe, Japan

[21] Appl. No.: 684,093

[22] Filed: Jul. 19, 1996

[30] Foreign Application Priority Data

Jul. 28, 1995 [JP] Japan ..... 7-193609

[51] Int. Cl.[6] ..... C21B 7/02

[52] U.S. Cl. ..... 266/275; 266/286; 432/250

[58] Field of Search ..... 266/275, 280, 266/286; 432/250, 264

[56] References Cited

U.S. PATENT DOCUMENTS 1,488,026 3/1924 Reilly ..... 266/275

4,118,018 10/1978 Gruner et al. ..... 266/275

4,912,068 3/1990 Michael et al. ..... 266/286

FOREIGN PATENT DOCUMENTS

A-610031 1/1986 Japan .

*Primary Examiner*—Scott Kastler

*Attorney, Agent, or Firm*—Oliff & Berridge, P.L.C.

[57] ABSTRACT

Ladles used for vacuum refining processes, for example a VOD process, are provided with covers to cover openings of ladles. The covers generally consist of refractories, which are required to have excellent resistance to thermal spalling due to heat cycles and not inhibit decarbonization during refining processes of molten steel. The ladle cover comprises a refractory having a carbon content 5 wt % or more. Preferably, a refractory has a carbon content 5 wt % or more is used for a central section of the ladle cover, and a refractory having a carbon content less than 5 wt % is used for peripheral sections of the ladle cover.

16 Claims, 2 Drawing Sheets

LADLE COVER FOR VACUUM REFINING PROCESS

BACKGROUND OF THE INVENTION

1. Field of the Invention

The invention relates to covers that are placed on ladles to cover openings on the ladle. The ladles are used in vacuum refining processes, such as Vacuum Oxygen Decarbonization (VOD).

2. Description of the Related Art

In VOD equipment for secondary refining of molten steel, a ladle is placed in a vacuum chamber under reduced pressure. The ladle is provided with a cover. The cover prevents spattering and deposition of molten steel or slag into the vacuum chamber. The spattering and deposition may be caused by bubbles from bubbling gas, decarbonization, deoxidation, or denitrodation in the ladle. The ladle cover also suppresses thermal radiation of a steel bath during a refining process.

In general, a ladle cover is formed from refractories. A known ladle cover is made of a ceiling refractory formed of a combination of unburned $MgO—Cr_2O_3$ with graphite, and is disclosed in Tables 13 and 19 of "Steel Handbook, Iron Making and Steel Making" 3rd edition, (page 712) (Maruzen). In the ladle cover of "Steel Handbook", a lance hole for a top blowing lance is made of graphite, where other sections are made of unburned $MgO—Cr_2O_3$. Unburned $MgO—Cr_2O_3$, which is a refractory of an insulation fire brick nature having a thermal conductivity of 1.5 kcal/mH° C., is provided over the entire ceiling, except at a periphery of the lance hole.

In the "Steel Handbook" cover, the cover has a set radius. A circular area or section radially within 70 to 80% of a cover's center is rapidly heated by radiation heat from molten steel during refining periods. The section is also cooled during nonrefining periods to define a thermal cycle. Such repeated thermal cycles facilitate thermal spalling. Thus, the life of the refractory is shortened.

Deterioration due to thermal spalling can be prevented by providing a spalling resistive material, for example graphite, over the entire ceiling. However, the use of graphite will cause a problem in processes that produce ultra low carbon steels. (In such a process, the graphite is dissolved and inhibits decarbonization.) The graphite lined on an inner surface of a ladle cover is consumed as a result of secondary combustion, which is unavoidably caused by top blowing oxygen in a space defined between the molten steel surface in the ladle and the ladle cover. This results in a shortened life of the refractory.

A watercooling type ladle cover is disclosed in Japanese Laid Open Patent No. 610031 (JP 031). The JP 031 ladle cover is provided with watercooling tubes to continuously circulate cooling water so that the tube is thermally protected and has a very long life. The watercooling type ladle cover reduces production and maintenance costs of ladle covers.

In the JP 031 watercooling type cover, the heat radiated from molten metal is conducted away from the cover by the cooling water in the watercooling tubes. The watercooling tubes are maintained at a low temperature during the process, so a temperature of the molten steel drastically decreases during the process. Thus, a large amount of heat must be added during the process to maintain molten steel. This results in a substantial and often uneconomical increases in production costs.

SUMMARY OF THE INVENTION

It is an object of the invention to provide a ladle cover that exhibits excellent durability against thermal spalling due to thermal heating cycles. Thus, the ladle cover will have a longer refractory life.

The ladle cover can be placed on a ladle for vacuum refining of molten steel, where the ladle cover preferably comprises a refractory containing approximately 5 wt % or more of carbon. The carbon content of the refractory is further preferably limited to approximately 20 wt % or less, to achieve a satisfactory decarbonization.

Another object of the invention is to provide a cover in a diskshape to be placed on a ladle for vacuum refining of molten steel. A peripheral section of a lance hole for a top blowing lance of the ladle cover is formed by a refractory containing approximately 5 wt % or more of carbon. An outer radial section of the peripheral section can be formed by a refractory containing less than approximately 5 wt % carbon. In particular, it is preferable that a refractory having a carbon content of approximately 5 wt % or more be provided at in a circular area or section of the cover at a radial inner section within approximately 90% from the cover's center. A refractory having a carbon content less than 5 wt % can be provided in the radial outer section outside the 90% radial inner section.

A ladle cover according to the invention has prolonged life due to improved resistance to thermal spalling because the ladle cover is formed with a refractory having a carbon content approximately 5 wt % or more. The resistance to thermal spalling can be further improved, without resulting in a detrimental influence from decarbonization, by lining the ladle cover with more than two refractories each having different carbon contents.

Other objections, advantages and salient features of the invention will become apparent from the following detailed description, which, taken in conjunction with the annexed drawing, discloses preferred embodiments of the invention.

DESCRIPTION OF THE PREFERRED EMBODIMENTS

Figure 1:
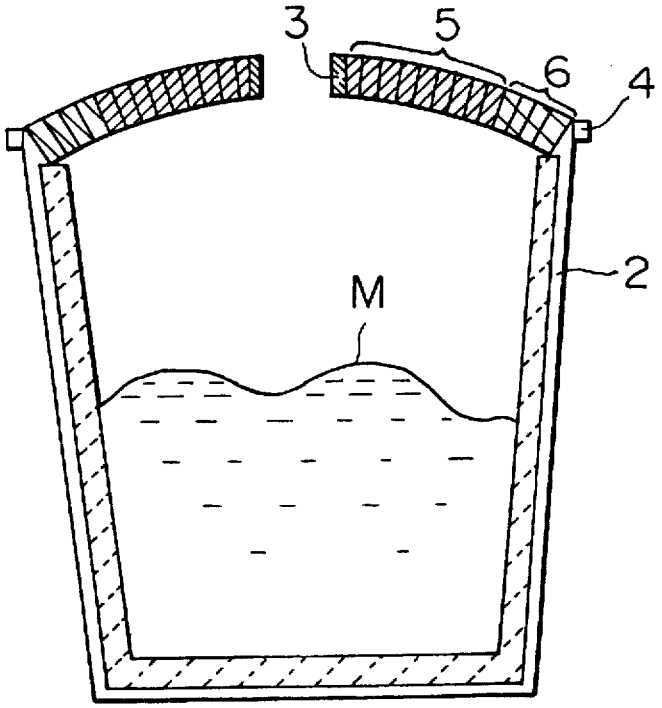
FIG. 1 is a schematic view illustrating a ladle and a ladle cover.

A preferred embodiment of the invention is shown in FIG. 1. In FIG. 1, a ladle cover 1 is placed on a ladle 2 to cover an opening in the ladle 2. The ladle cover 1 is formed with a diskshaped body and has a lance hole 3 lined with a refractory, for example a refractory comprising graphite. A top blowing lance can be inserted in the lance hole 3. The lance hole 3 is, for example, positioned in the center of the cover 1.

The periphery of the ladle cover 1 is encircled by a peripheral metal frame 4. The ladle cover 1 between the lance hole 3 and the peripheral metal frame 4 is lined with at least one refractory. The refractory may have any appropriate composition and may be another type of refractory, other than the refractory at the lance hole 3.

Thermal spalling of refractories due to heat is most likely caused by irregularities in temperature during heating and cooling of the molten metal. When a thermal conductivity of the refractory is high, heat diffusion is promoted inside the refractory. Thus, temperature deviation in the refractory becomes smaller. To improve the resistance to thermal spalling due to heat, a higher thermal conductivity is desirable.

In order to obtain a ladle cover 1 with excellent resistance to thermal spalling due to heat, the refractories should preferably have a carbon content approximately 5 wt % or more.

Thermal conductivity of a refractory significantly varies with its carbon content. For example, in MgO refractories, thermal conductivities at 500° C. are 5 kcal/mH° C. for a MgO refractory, 9 kcal/mH° C. for a MgO—C refractory containing 5 wt % of carbon, 11 kcal/mH° C. for a MgO—C refractory containing 10 wt % of carbon, and 16 kcal/mH° C. for a MgO—C refractory containing 15 wt % of carbon. Similarly, thermal conductivities at 1,000° C. are 3.5 kcal/mH° C. for a MgO refractory, 6.5 kcal/mH° C. for a MgO—C refractory containing 5 wt % of carbon, 8 kcal/mH° C. for a MgO—C refractory containing 10 wt % of carbon, and 16 kcal/mH° C. for a MgO—C refractory containing 13 wt % of carbon.

Thermal impact resistance temperature differential is an index of resistance to thermal spalling due to heat. The thermal impact resistance temperature differential of various materials was investigated to determine if a correlation existed between carbon content in MgO refractories and resistance to thermal spalling due to heat. In particular, a thermal impact resistance temperature differential between a room temperature and a temperature where breakage and/or cracks do not occur when a refractory at room temperature is rapidly exposed to a high temperature atmosphere with respect to carbon content of the refractory was investigated. Test results are shown in FIG. 3.

Figure 3:
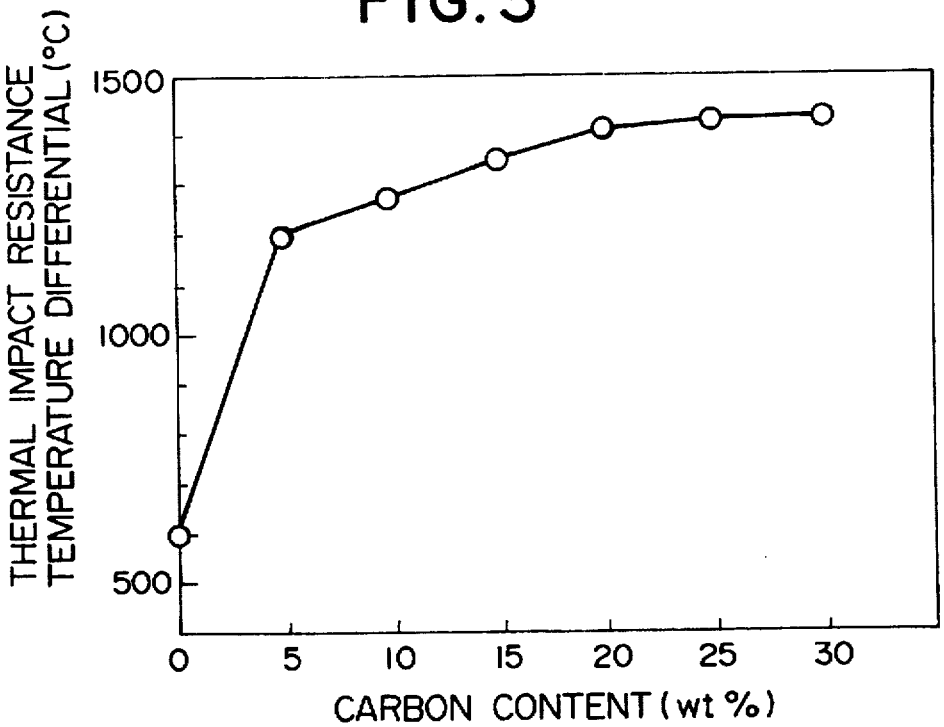
FIG. 3 is a graph illustrating a correlation between carbon content in a refractory and a thermal impact resistance temperature differential.

FIG. 3 illustrates that thermal impact resistance temperature differential rapidly increases when carbon content in the refractories exceeds 5 wt %. Further, the thermal impact resistance temperature differential increases when carbon content in the refractories exceeds 20 wt %. The results indicate resistance to thermal spalling due to heat in a ladle cover comprising refractories can be improved by using refractories having a carbon content approximately 5 wt % or more. The results also indicate that resistance to thermal spalling can be further improved with a refractory having a carbon content approximately 20 wt % or more.

When the carbon content in the refractories comprising the ladle cover increases, some carbon may drop off of the ladle cover during decarbonization. Thus, the carbon will enter molten steel and inhibit decarbonization. Therefore, average decarbonization rates for molten steel were investigated, using crucibles made of MgO—C refractories having different carbon contents. Test results are shown in FIG. 4.

Figure 4:
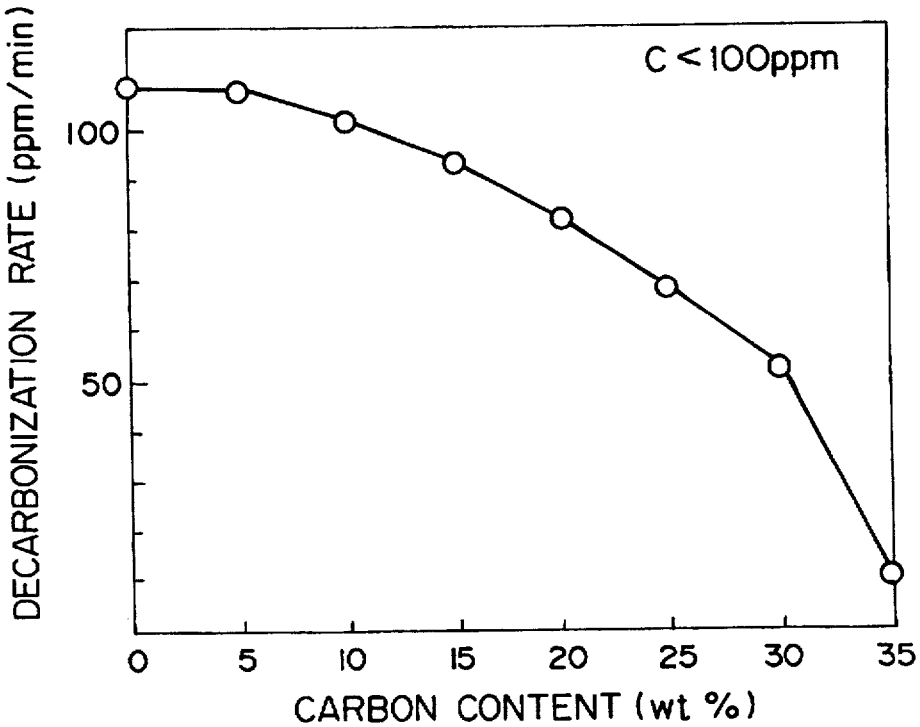
FIG. 4 is a graph illustrating a correlation between carbon content in a refractory and a decarbonization rate.

FIG. 4 illustrates that decarbonization rates do not rapidly decrease until the carbon content refractories is approximately 10 wt %. Since a lower limit for practical decarbonization rates is 80% of a decarbonization rate with a refractory containing less than 5 wt % of carbon, a refractory with a carbon content of approximately 20 wt % or less will permit practical decarbonization.

The above test results indicate that resistance to thermal spalling due to heat in the ladle cover is improved by using a refractory having a carbon content approximately 5 wt % or more. The results also indicate a decrease in the decarbonization rate during the decarbonization is prevented by limiting the carbon content in the refractory to approximately 20 wt % or less.

When a ladle cover is formed of two kinds of refractories, each having different carbon contents, a resistance to thermal spalling due to heat in the ladle cover can be improved without harmfully influencing decarbonization. For example, a radial inner section 5 of the ladle cover surrounding the lance hole 3 can be lined with a refractory containing approximately 5 wt % or more of carbon. A radial outer section 6 of the ladle cover surrounding the inner section 5 can be lined with a refractory containing less than approximately 5 wt % of carbon.

This arrangement is effective because the radial inner section 5 of the ladle cover 1 just above steel bath M is subject to severe heat cycles that may cause thermal spalling. When the radial inner section 5 of the ladle cover 1 is lined with a refractory having a carbon content approximately 5 wt % or more, the resistance to thermal spalling due to heat is improved. The radial outer section 6 is lined with a refractory having a carbon content less than approximately 5 wt %, so it barely acts as a carbon source. Thus, the ladle cover 1 has excellent resistance to thermal spalling due to heat, and does not inhibit decarbonization.

FIG. 3 illustrates that a refractory having a carbon content approximately 20 wt % or more is preferable for the radial inner section 5. The area of the radial inner section 5 in the ladle cover 1 must be controlled, so decarbonization is not inhibited even if a refractory having a carbon content approximately 20 wt % or more is used.

In FIG. 4, an area of the refractory having a carbon content approximately 5 wt % is (1X), and an area of the refractory having a carbon content approximately 20 wt % of carbon is X. The decarbonization rate can then be expressed by the equation:

$$108\times(1X)+82\times X \quad \text{(ppm/min)}$$

Since it is desirable to have a low decarbonization rate, preferably 80% of a decarbonization rate with a refractory having a carbon content less than 5 wt %, the decarbonization rate can be expressed by the equation:

$$108\times(1X)+82\times X \geqq 109\times 0.80 \quad \text{(ppm/min)}$$

From this equation, $X \geqq 0.80$. Accordingly, the area of the radial inner section 5 using a refractory having a carbon content 5 wt % or more is preferably limited to approximately 80% or less of the ladle cover 1. Further, a corresponding radius ratio of a radius of the radial inner section to the radius of the ladle cover 1 is limited to 90% or less.

However, when the area of the radial inner section 5 drastically decreases, the resistance to thermal spalling due to heat at the periphery is significantly affected by radiant heat. Thus, it is preferable that radial inner section 5 have an area of 40% or more of the ladle cover 1, or a radius ratio i.e., a ratio of the radius of the radial inner section 5 to the radius of the ladle cover 1, approximately 65% or more. Since the lance hole 3 occupies at most approximately 10% of the cover ladle area, a ladle cover 1 where only the lance hole 3 is made of a high carbon content refractory is unsatisfactory.

Accordingly, the radial inner section 5 of the ladle cover 1 formed with a refractory having a carbon content approximately 5 wt % or more preferably has an area of 40 to 80% of the cover, or has a radius ratio of 65 to 90%. Preferably, the radial inner section 5 of the ladle cover 1 has an area of 64 to 80% of the cover, or a radius ratio of 80 to 90%.

Further, the carbon content of the refractory at the radial inner section 5 is preferably approximately 5 to 30 wt %. More preferably, the carbon content of the refractory of the radial inner section 5 is approximately 10 to 20 wt %, given the relation of resistance to thermal spalling due to heat and decarbonization rate.

Figure 2:
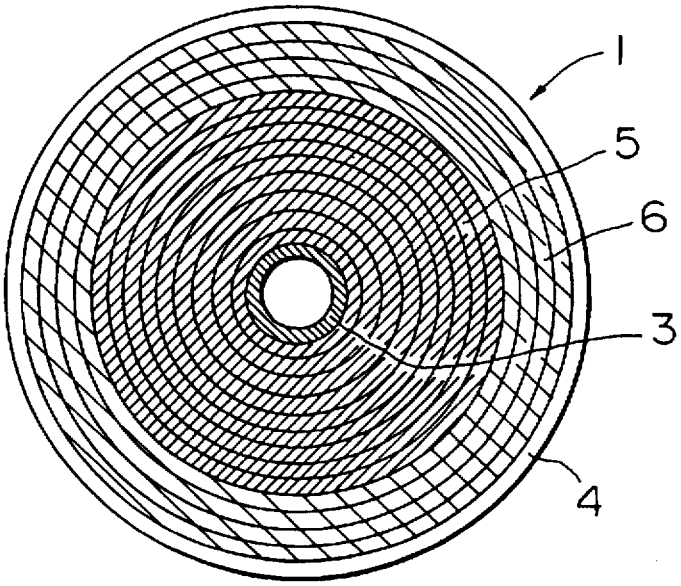
FIG. 2 is a schematic plane view of a ladle cover.

Various refractory integrated structures for the ladle cover can be used in accordance with the invention. Although diskshape block fabrication ladle cover is shown in FIG. 1 and FIG. 2, other shaped structures are contemplated by the invention. For example, a plurality of refractories with at least one projection and recess section fit to each other is contemplated herein, a plurality of independent ringshaped arches having different radii are formed from refractories is also possible in accordance with the invention.

An example of the invention will now be described. With VOD equipment for secondary refining of molten steel, having a capacity of 160 tons. Vacuum refining processes were carried out with carbon concentrations of molten steel at 0.10 wt % to 30 ppm. An diskshape ladle cover 1, as shown in FIG. 1 and FIG. 2 was used with the VOD equipment. The specifications for the covers and carbon contents of MgObase refractories are illustrated in Table 1.

Table 1 also illustrates the life of ladle covers until refractories in the ladle dissolved and the covers dropped out during decarbonization processes. Table 1 also illustrates average decarbonization times.

TABLE 1

| | Specifications | Life until Refractories Drop out (heat) | Average Decarbonization Time (min) |
|---|---|---|---|
| Example 1 | All MgO—C refractories containing 7 wt % of carbon | 283 | 14 |
| Example 2 | MgO—C refractories containing 30 wt % of carbon for the section within 70% of the radius from the center, and MgO—$Cr_2O_3$ base refractories for the residual section. | 280 | 15 |
| Example 3 | MgO—C refractories containing 20 wt % of carbon for the section within 90 wt % of the radius from the center, and magnesia dolomitebase refractories for the residual section. | 300 | 15 |
| Example 4 | All MgO—C base refractories containing 20 wt % of carbon. | 285 | 20 |
| Comparative Example 1 | All MgO—$Cr_2O_3$ base refractories. | 100 | 14 |
| Comparative Example 2 | MgO—C base refractories containing 15 wt % of carbon for the section within 10 wt % of the radius from the center, and magnesia dolomitebase refractories for the residual section. | 120 | 14 |

As clearly indicated, Table 1 demonstrates that ladle covers, in accordance with the invention, have extremely prolonged life compared with Comparative Examples 1 and 2.

What is claimed is:

1. A ladle cover that is placed on a ladle comprising:

a refractory material defining a lance hole, the refractory material including a first refractory at a radial inner section of the ladle cover and spaced from the lance hole, and a second refractory at a radial outer section of the ladle cover, the first and second refractories having a different carbon content.

2. A ladle cover according to claim 1, wherein said refractory has a carbon content approximately 20 wt % or less.

3. A ladle cover according to claim 1, wherein the lance hole is formed at a center of the ladle cover.

4. A ladle cover according to claim 1, wherein the ladle cover is diskshaped.

5. A ladle cover according to claim 1, wherein the refractory is a MgO—C refractory.

6. A ladle cover according to claim 1, wherein the first refractory has a carbon content of approximately 5 wt % or more and less than 20 wt %, and the second refractory has a carbon content of less than approximately 5 wt %.

7. A ladle cover that is placed on a ladle comprising:

a body having a radial inner section that includes a refractory having carbon content of at least 5 wt % and a radial outer section that includes a refractory having carbon content of at most 5 wt %, the body defining a lance hole that is lined with a refractory having carbon content of at least 5 wt %.

8. A ladle cover according to claim 7, wherein the body has a generally round periphery and defines a body radius, the radial inner section defines radial inner section radius and a first cover area, a radius ratio is defined by a ratio of the radial inner section radius and the body radius, the radial inner section defining a radius ratio of approximately 90%, a second cover area comprising the ladle cover other than the first area, the first cover area comprising a refractory having a carbon content approximately 5 wt % or more and the second cover area comprising a refractory having a carbon content less than approximately 5 wt %.

9. A ladle cover according to claim 7, wherein the first cover area defines a radius ratio between approximately 65% and 90%, comprising a refractory having a carbon content approximately 5 wt % or more and less than approximately 30 wt %, and other areas of the ladle cover comprise a refractory having a carbon content less than approximately 5 wt %.

10. A ladle cover according to claim 7, wherein the first ladle cover area defines between approximately 64% and 80% of the body.

11. A ladle cover according to claim 7, wherein the refractory has a carbon content 20 wt % or less.

12. A ladle cover according to claim 7, wherein the ladle cover is diskshaped.

13. A ladle cover according to claim 7, wherein the refractory is a MgO—C refractory.

14. A ladle cover according to claim 7, the ladle cover further defining a lance hole formed at a center of the body, the lance hole comprising a refractory having a carbon content approximately 5 wt % or more.

15. The ladle cover according to claim 7, wherein the refractory has a carbon content between approximately 5 wt % and 20 wt %.

16. The ladle cover according to claim 15, wherein the refractory is a MgO—C refractory.

* * * * *